United States Patent [19]

Meheen

[11] 4,282,690

[45] Aug. 11, 1981

[54] PRECAST BUILDING CONSTRUCTION

[76] Inventor: H. Joe Meheen, 1550 Dover, Suite 7, Lakewood, Colo. 80215

[21] Appl. No.: 68,940

[22] Filed: Aug. 23, 1979

[51] Int. Cl.[3] ..... E04H 1/04

[52] U.S. Cl. ..... 52/79.11; 52/79.13; 52/79.14; 52/125; 52/283

[58] Field of Search ..... 52/79.1, 745, 79.13, 52/79.14, 125, 236.6, 73, 583, 283

[56] References Cited

U.S. PATENT DOCUMENTS

| | | | |
|---|---|---|---|
| 2,618,146 | 11/1952 | Ciarlini | 52/236.6 |
| 3,105,999 | 10/1963 | Piazolo | 52/73 |
| 3,354,593 | 11/1967 | Zukas | 52/73 |
| 3,462,908 | 8/1969 | Wysocki | 52/236.6 |
| 3,696,567 | 10/1972 | Villaneu | 52/125 |
| 3,708,933 | 1/1973 | Yang | 52/263 |
| 3,722,159 | 3/1973 | Kessler | 52/583 |
| 3,742,660 | 7/1973 | Bierweiler | 52/125 |
| 3,762,115 | 10/1973 | McCaul | 52/236.9 |
| 4,099,360 | 7/1978 | Outram | 52/583 |

OTHER PUBLICATIONS

Netherlands Printed Application 6,804,097, Oct. 1968, 10 pp. of spec. 3 pp. of drawings.

*Primary Examiner*—John E. Murtagh

*Attorney, Agent, or Firm*—Sheridan, Ross, Fields & McIntosh

[57] ABSTRACT

A precast building construction unit is provided for forming a substantially complete building. The unit includes a wall tree unit having a vertically extending wall segment and at least one cantilever member joined at right angles thereto. Pairs of wall tree units are spaced apart and their cantilever members are coaxially directed toward each other so that a base slab unit is connected therebetween. The wall segments thereby form the vertical walls and the cantilever members and base slab units comprise the floors and ceilings of the building. Additional wall tree units can be connected above each of the spaced wall tree units as well as laterally adjacent each of the wall tree units so that building structures of various heights and widths can be provided. A hoisting eye is provided at an end of each of the wall segments to permit carrying and lifting of the wall tree units and to enable the connecting of vertically adjacent wall tree units together.

2 Claims, 13 Drawing Figures

PRECAST BUILDING CONSTRUCTION

DESCRIPTION

1. Technical Field

The present invention relates to prefabricated building units and, in particular, to interconnectible buidling walls and floors.

2. Background Art

With increasing construction costs and the desire to minimize construction time for any size building, precast building units are considered to be of significant benefit to building contractors and their customers. Although a variety of precast structures have previously been provided, the combination of a wall tree unit and a base slab unit as hereinbelow described is unique since from these two basic units, a substantially complete building can be formed. In U.S. Pat. No. 3,354,593 to Zukas, a precast building structure having columns supporting cantilever slabs is provided. The gaps between adjoining cantilever slabs are bridged by bridging slabs and a set of four bridging slabs is closed by an in-filling slab. In U.S. Pat. No. 3,708,933 to Yang, precast concrete vertical columns connected by horizontal members is shown. In U.S. Pat. No. 3,788,012 to Arnold, a precast structure element is described having a column supporting the center of a slab. A plurality of the structural elements are joined in a side-by-side relationship to form the floor of the building. The structural elements may be stacked one on top of the other and aligned with a pin which is partially embedded in the bottom part of the column and extends downward into an upward facing sleeve in the top center of the lower slab.

DISCLOSURE OF INVENTION

In accordance with this invention, a precast building unit is provided comprising at least two wall tree units and a base slab unit. Each wall tree unit includes at least one cantilever member joined at a right angle to a wall segment. A first end of the wall segment is attachable to a connecting structure while a second end includes a hoisting eye for gripping engagement by a crane to position the wall tree unit where desired. The two wall tree units are spaced to receive the base slab unit therebetween. Edges of the cantilever members engage lateral ends of the base slab unit to form a unitary building structure including a floor and vertical extending walls.

More particularily, a precast building structure is provided which is formed from building elements constructed at one location which can be subsequently erected at a remote construction site. The structure includes at least two spaced wall tree units. Each wall tree unit has a planar wall segment approximately two stories in height and at least two planar cantilever members extending at right angles from each of the wall segments. The cantilever members of each wall tree unit are generally spaced a distance of one story from each other while the corresponding cantilever members of the spaced wall trees are coaxial or aligned with respect to each other so that a base slab unit is positioned generally horizontally between the two spaced wall tree units. Additional wall tree units can be supported above each of the two spaced wall tree units so that a building comprising a number of stories is formed. These vertically adjacent wall tree units are connected together by means of threaded shafts extending from a first end of a first wall segment while a hoisting eye is formed in a second end of the vertically adjacent second wall segment to receive the threaded end of the shaft of the first wall segment and connect the two wall segments together. Additional wall tree units can also be connected to the side edges of each of the two spaced wall tree units so that the lateral extension of the building is increased. The side edges can be connected together by means of overlapping angle members mounted on two horizontally adjacent wall segments and a bolt holding them together.

Based on the foregoing, it is readily apparent that the present invention provides a number of worthwhile advantages. The wall tree units and base slab units of this invention, when joined together, form a substantially complete building. The wall tree unit and base slab unit are precast so that they can be formed prior to transporting them to a work site. The precasting is inexpensively accomplished and building construction time is significantly minimized. The building units provide the capability of use in various sized buildings, including office and industrial buildings, apartments and parking structures. The building elements are typically made of reinforced concrete thereby assuring durability and long-lasting construction. Additional advantages of this invention are readily apparent from the following description taken in conjunction with the accompanying drawings.

DESCRIPTION OF THE PREFERRED EMBODIMENT

Figure 1:
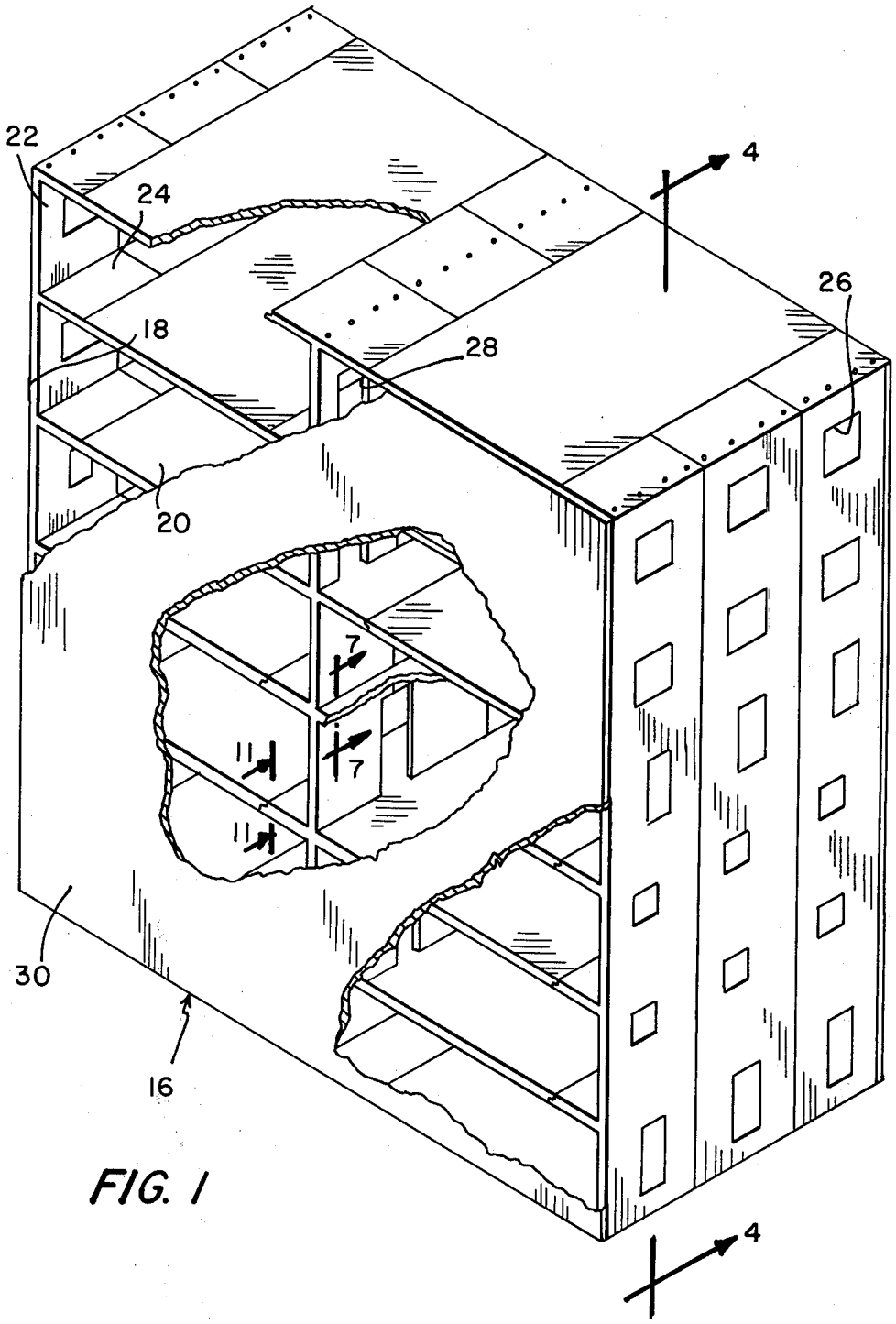
FIG. 1 is a perspective view of a building constructed from the building units of this invention.

In accordance with the present invention, a building 16 is shown in FIG. 1 constructed from wall tree units 18 and base slab units 20. The wall tree units 18 each include a wall segment 22 and a cantilever member 24 joined at right angles to wall segment 22. As seen in FIG. 1, three sets of three horizontally adjacent wall tree units 18, each of the horizontally adjacent wall tree units 18 comprising a number of vertically adjacent wall tree units 18, are provided. Two of such sets form exterior faces or walls of the building while the third set is positioned within the building 16 between the other two sets. The exteriorly positioned wall tree units 18 each include a single cantilever member 24 while the intermediate positioned wall tree units 18 placed within the building each have a first and a second cantilever member 24 which are generally coaxial and extend in opposite directions from wall segment 22. The outer and intermediate wall tree units 18 are spaced such that the cantilever members 24 extending toward each other are axially aligned.

Each wall tree unit 18 and base slab unit 20 is precast according to desired specifications, typically, from concrete to provide a durable and permanent construction. The height of the wall tree unit 18 can vary from one to several conventional building stories. The width or lateral extent of the wall tree units can also vary base on individual requirements, for example, from four feet to twenty four feet. The thickness of the wall segments, cantilever members and base slab units can also be varied and is generally in the order of six inches. Windows 26 and doorways 28 are also preformed in desired locations in the wall segments 22. The base slab units 20 are positioned between and connected to the spaced axially aligned cantilever members 24 to form the floor and ceilings of the building 16 and exterior slab 30 is conventionally formed and connected over opposite faces of the building 16 to provide a completely enclosed structure. The exterior slab 30 can also be precast and typically includes a number of panels which are subsequently joined together when the building 16 is formed. The exterior slab 30 may also have windows or other openings. In addition, exterior slab 30, as well as the wall tree units 18, can be faced with aesthetic surfaces, such as brick.

Figure 13:
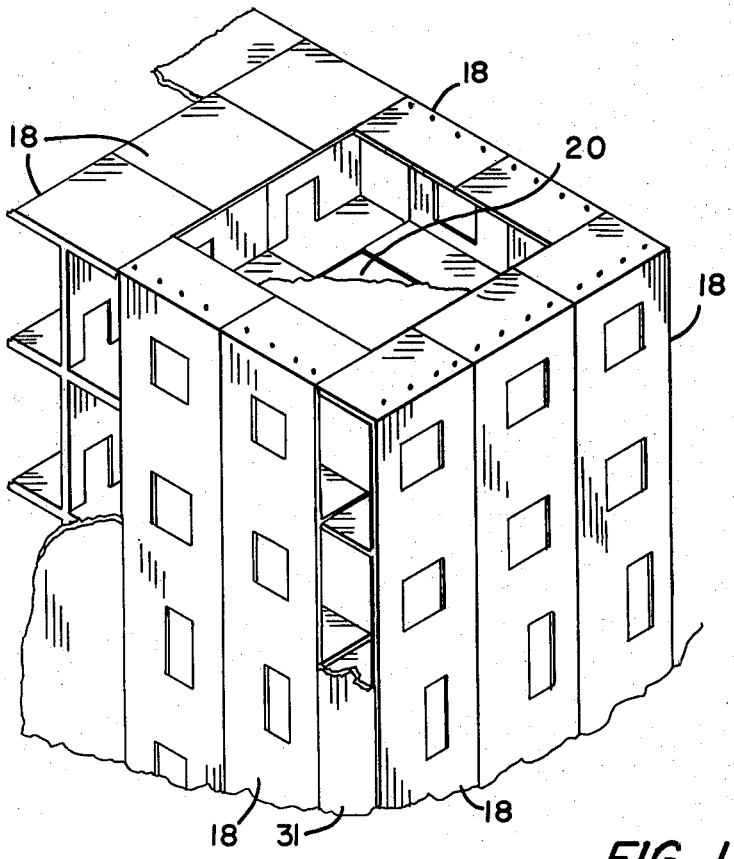
FIG. 13 is a perspective view showing wall tree units at right angles with respect to each other to enclose a building.

FIG. 13 illustrates the use of additional wall tree units 18, rather than the exterior slab 30, so that the generally rectangular shaped building 16 has wall tree units 18 for forming the four exterior walls of the building 16. In this embodiment, wall tree units 18 are positioned at right angles with respect to each other. It being understood that such wall tree units can be positioned in a number of suitable ways to provide the enclosing walls of the building 16. As shown in FIG. 13, all cantilever members 24 are positioned inwardly of the building 16. Corner portions 31 of the building 16 cannot be formed using wall tree units having inwardly extending cantilever members 24 because of the presence of cantilever members 24 positioned at right angles thereto. However, each of the cantilever members could be beveled to permit proper alignment with respect to each other. In another embodiment, standard panels or wall segments 22 without the cantilever members extending therefrom could be provided along the corners of the building 16 to complete the enclosing thereof. Alternatively, wall tree units 18 with the cantilever members 24 extending outwardly of the building 16 could also be used to complete the enclosing thereof.

Figure 2:
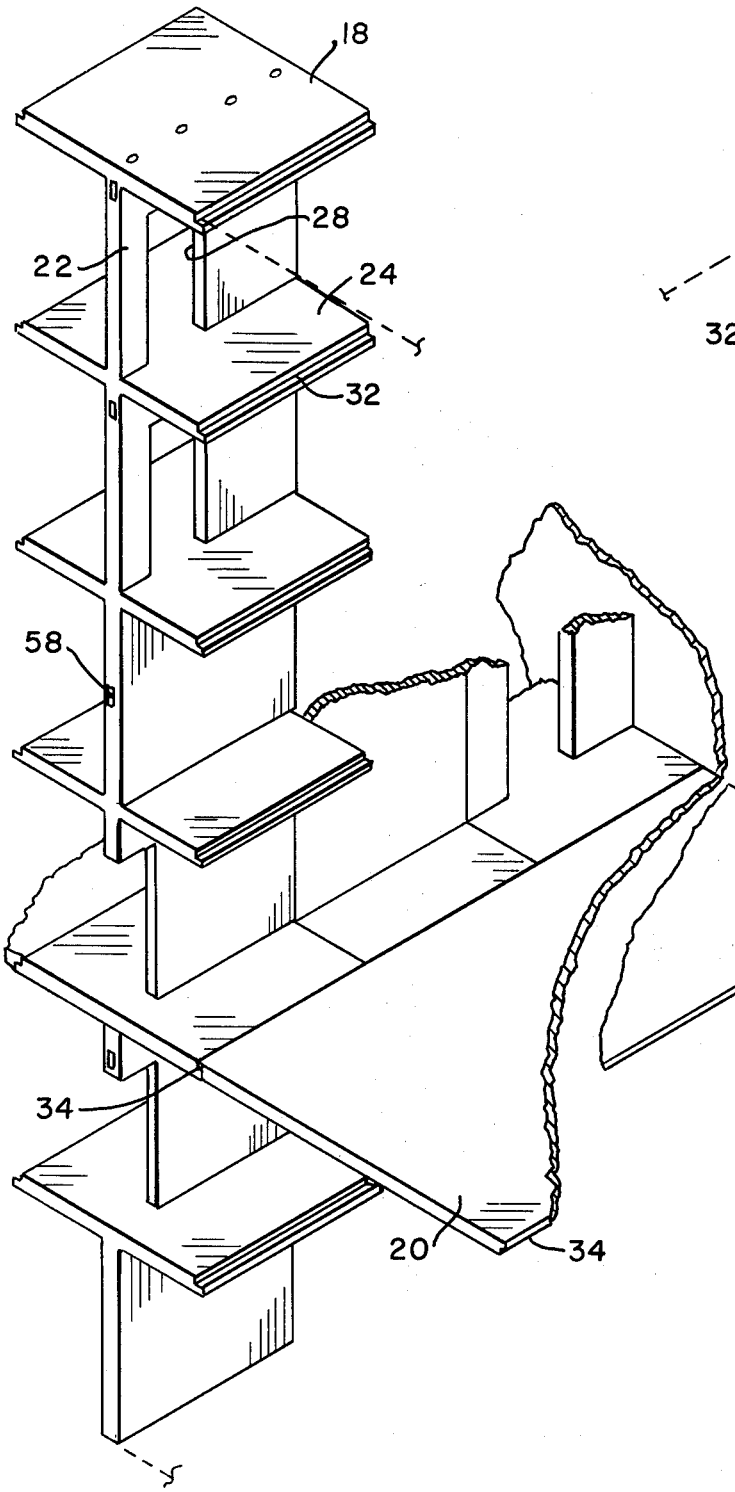
FIG. 2 is a perspective view showing wall tree units having cantilever members extending from opposite sides of the wall segments with a base slab unit connected to cantilever members.
Figure 3:
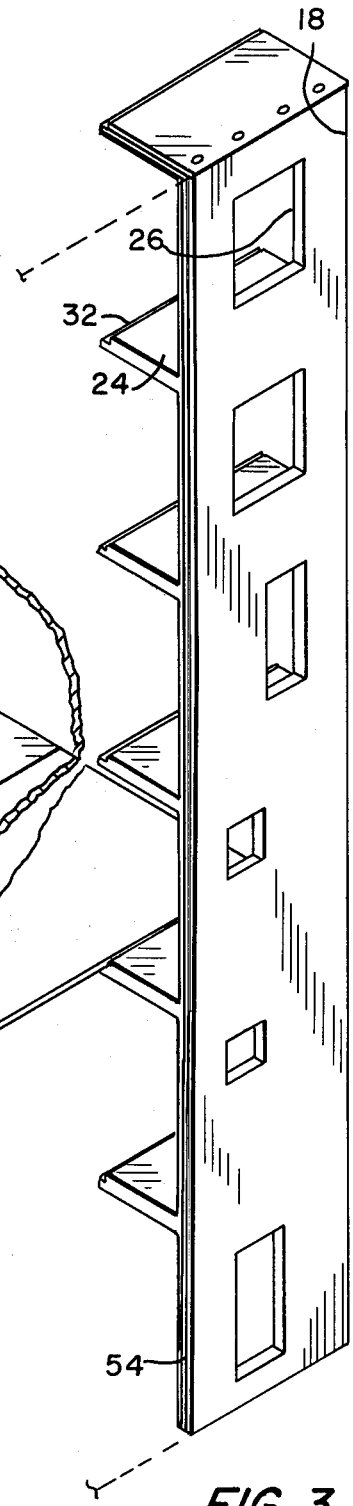
FIG. 3 is a perspective view showing cantilever members extending from one side of the wall segments.

The interconnecting wall tree units 18 and base slab units 20 are further illustrated in FIGS. 2 and 3. It is seen that the cantilever member 24 has essentially the same lateral extent as that portion of the wall segment 22 to which it is attached. A rabbet 32 is formed along the laterally extending outer edge of cantilever member 24. Each base slab unit 20 has a flange 34 formed along its two laterally extending opposite outer edges. Each of the flanges 34 of a base slab unit 20 is matingly joined to a rabbet 32 from spaced cantilever members 24 and the base slab unit 20 is supported thereby. Typically, a base slab unit 20 extends two-thirds of the axremaining one-third of the distance.

Figure 12:
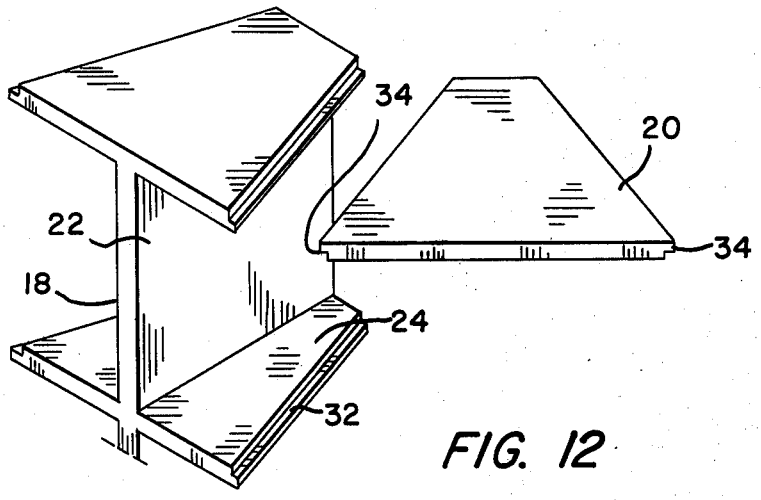
FIG. 12 is a perspective view showing the wall tree unit and base slab unit having a trapezoidal shape.

Although a generally planar, rectangular shaped wall segment 22, cantilever member 24 and base slab unit 20 are depicted in FIGS. 2 and 3, other configurations are equally feasible. In FIG. 12, a generally trapezoidal shaped base slab unit 20 and cantilever member 24 are depicted. Similar to the rectangular shaped units, the lateral extent of cantilever member 24 of the trapezoidal shaped units is substantially the same as the portion of the wall segment 22 to which it is attached. The outer edges of the cantilever member 24 also include a rabbet 32 while the edges of the base slab unit 20 include flanges 34 for engagement with rabbets 32 of cantilever members 24.

Figure 4:
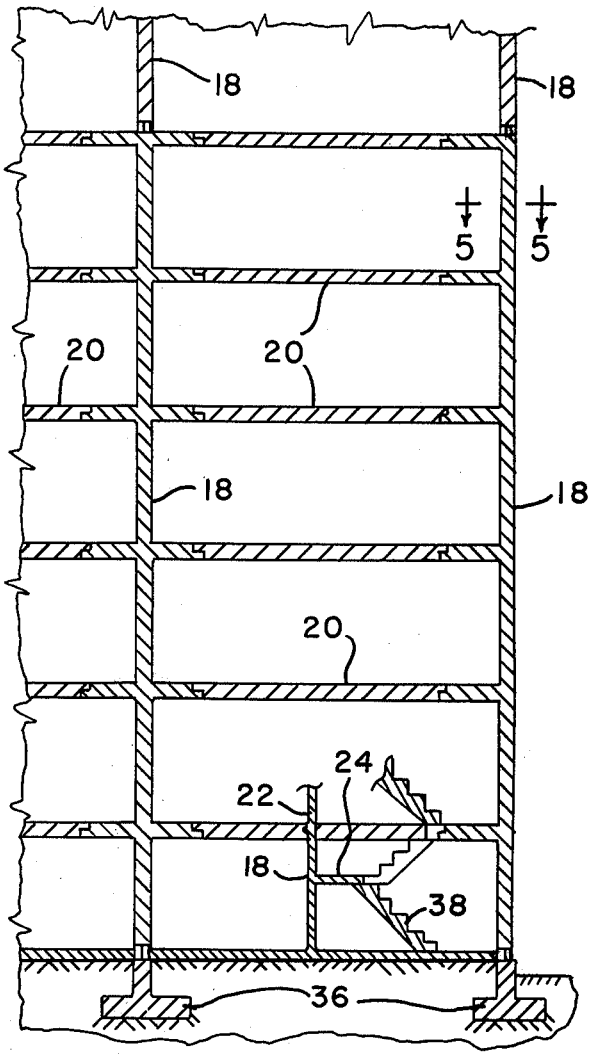
FIG. 4 is a fragmentary, longitudinal section, taken along line 4—4 of FIG. 1, showing the formation of a number of building stories from the wall tree units and base slab units.

Using wall tree units 18 to support stairways in building 16 is shown in FIG. 4. A foundation 36 is provided which acts as the supporting structure for the tiers of building elements. Between the intermediate wall tree units 18, which have cantilever members 24 extending from two opposing sides, and the outer wall tree units 18 which form the outer faces of the building 16, another wall tree unit 18 is positioned. The rabbet 32 of the cantilever member 24 of this wall tree unit 18 supports a stairway or ramp structure 38. In addition to supporting stairways, the cantilever members 24 can also act as balconies or overhangs when positioned to extend outwardly of a building 16.

Figure 5:
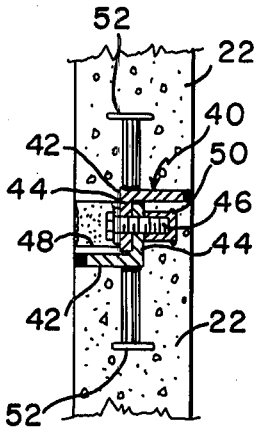
FIG. 5 is an enlarged, fragmentary, lateral section, taken along line 5—5 of FIG. 4, showing one embodiment to interconnect horizontally adjacent wall segments.

The remaining FIGS. 5–11 illustrate a number of interconnecting means to join horizontally adjacent wall tree units together, vertically adjacent wall tree units together and cantilever members to base slab units. It being readily appreciated that, although such interconnectors are being described with regard to one particular building element interconnection, they may also be used to provide the other building element interconnections. As shown in FIG. 1, the width or lateral extent of building 16 is increased by joining wall tree units 18 along their horizontally adjacent side edges. One embodiment for providing such an interconnection is represented in FIG. 5. Horizontal interconnectors 40 are spatially positioned along the side edges of the pair of horizontally adajcent wall segments 22 to join them together. Horizontal interconnector 40 includes a pair of generally L-shaped angle members 42. A first angle member 42 is connected by a weld to one of the horizontally adjacent wall segments 22 while a second angle member 42 is connected by a weld to the other horizontally adjacent wall segment 22. Arms 44 of the angle members 42 overlap and have holes therein to receive a bolt 46 therethrough. Bolt 46 is inserted into a sleeve 48, formed by the horizontally adajcent wall segments 22, through the holes of arms 44 and is threaded into casing 50 to thereby hold the adjacent wall tree units 18 together. A suitable grout is then placed over the head of bolt 46 and fills the sleeve 48. Serrated studs 52 are preformed in the concrete wall segment 22 and are welded to angle members 42 to maintain proper positioning thereof adjacent the side edges of wall segment 22.

Figure 5A:
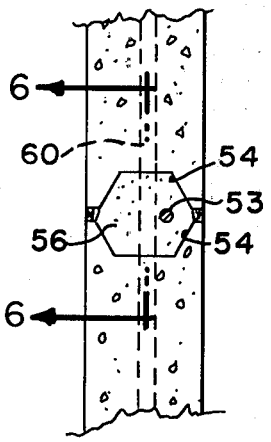
FIG. 5*a* is an enlarged, fragmentary, lateral section, similar to FIG. 5, but showing another embodiment to interconnect horizontally adjacent wall segments.
Figure 6:
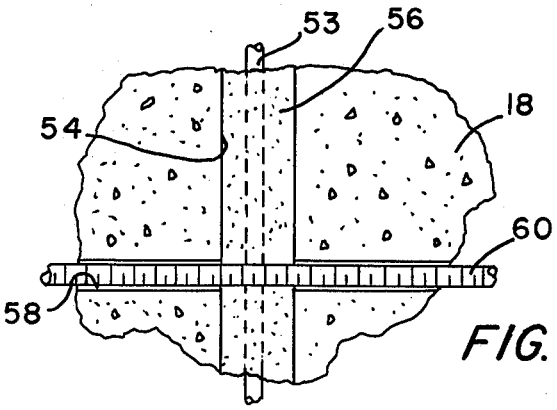
FIG. 6 is a fragmentary, longitudinal section, taken along line 6—6 of FIG. 5*a*, showing a further interconnection of horizontally adjacent wall tree units.

A second embodiment to interconnect horizontally adjacent wall tree units 18 is illustrated in FIG. 5*a*. The side edges of the wall segments 22 are grooved, as illustrated in FIG. 3. When a pair of wall segments 22 are positioned laterally next to each other, a vertically extending reinforcing pin 53 is located within adjacent grooves 54. A grout is used to fill the grooves 54 and a conventional adhesive 56, such as an epoxy, acts to hold the horizontally adjacent wall tree units 18 together. FIG. 6 shows additional means to interconnect horizontally adjacent wall tree units 18. As illustrated in FIG. 2, a passage 58 is formed in the side edges of wall segment 22 and extends through the entire width thereof. A rod 60 threaded throughout its length is inserted through passages 58. The rod 60 has a length substantially equal to the total width of all of the horizontally adjacent wall tree units 18 so that one threaded rod 60 joins all such horizontally adjacent wall tree units 18 together. The vertically extending reinforcing pin 53 is offset when placed within grooves 54 so that it does not contact the horizontally extending rod 60.

Figure 7:
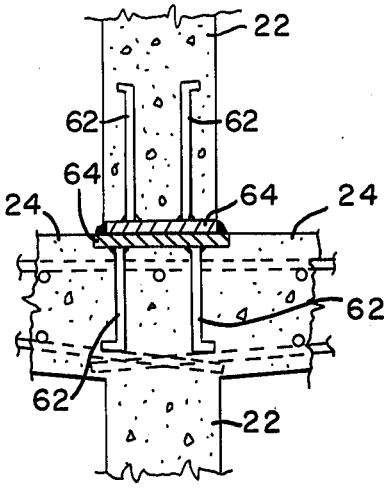
FIG. 7 is an enlarged, fragmentary, longitudinal section, taken along line 7—7 of FIG. 1, showing a connection for vertically adjacent wall tree units with cantilever members extending from both sides of a wall segment.
Figure 8:
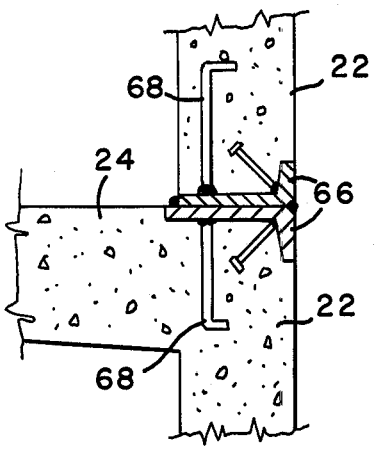
FIG. 8 is a longitudinal section similar to FIG. 7 showing a connection for vertically adjacent wall tree units, but with a cantilever member extending from one side of a wall segment.

Various interconnections for vertically adjacent wall tree units are depicted in FIGS. 7–10. In FIG. 7, wall segments 22 are preformed with bars 62 held within the ends thereof and with plates 64 attached by means of welds to the bars 62. Two vertically adjacent wall tree units are brought together and their respective plates 64 welded together to provide the connection. While FIG. 7 shows the interconnection of vertically adjacent wall tree units 18 having cantilever members 24 extending from opposite sides, FIG. 8 depicts an interconnection in which cantilever member 24 extends from one side of the wall segment 22. The plates 66 which are welded together are generally L-shaped and have preformed bars urging against the plates 66 and held there by welds to maintain position of the plates 66 at the ends of the wall segments 22.

Figure 9:
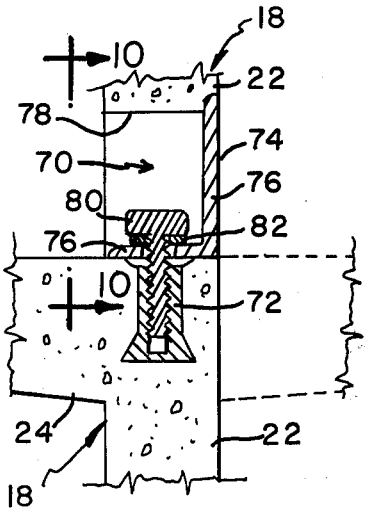
FIG. 9 is an enlarged, fragmentary, longitudinal section showing another embodiment to interconnect vertically adjacent wall tree units.
Figure 10:
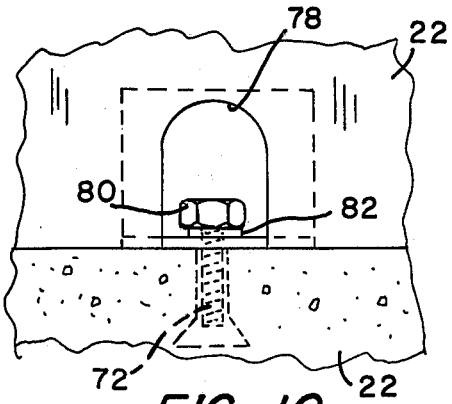
FIG. 10 is a longitudinal section, taken along line 10—10 of FIG. 9, showing further details of the interconnection.

FIGS. 9 and 10 illustrate a vertical interconnector 70 joining vertically adjacent wall tree units 18 together as well as providing means for positioning one wall tree unit 18 above another wall tree unit 18. Vertical interconnector 70 includes a threaded insert 72 formed in a first end of a wall segment 22 when the same is initially cast. An angle brace 74 is connected to the second end of wall segment 22, which is opposite the first end thereof, when the wall segment 22 is formed. Angle brace 74 is generally L-shaped with one arm 76 connected to one wall segment 22 while the other arm 76 is positionable to overlie the threaded insert 72 of a vertically adjacent wall segment 22. A hoisting eye 78 is provided in the space between angle brace 74 and the second end of wall segment 22. Hoisting eye 78 extends laterally along wall segment 22 and enables a lifting mechanism to grip the wall tree unit 18 thereat and move the wall tree unit 18 to a desired location. When connecting vertically adjacent wall tree units together, the first end of a first wall tree unit 18 is positioned contigously adjacent the second end of a second wall tree unit 18 so that the arm 76 of angle brace 74 overlies the insert 72. A threaded bolt or shaft 80 is inserted through each of a plurality of openings in the arm 76 and engages the insert 72 to connect the two vertically adjacent wall tree units 18 together. A washer 82 is located between the head of the bolt 80 and the arm 76. It is understood that the vertically adjacent wall tree units 18 are easily unfastened from each other after untightening the bolt connections.

Figure 11:
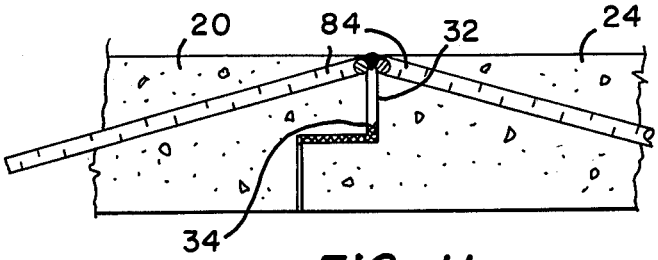
FIG. 11 is an enlarged, fragmentary, longitudinal section, taken along line 11—11 of FIG. 1, showing an interconnection of the cantilever member and base slab unit.

A third interconnection of the building elements is seen in FIG. 11 in which a base slab unit 20 is joined to a cantilever member 24. The rabbet 32 of the cantilever member 24 engages the flange 34 of base slab unit 20. A support piece 84 which is precast in both the cantilever member 24 and the base slab unit 20 extends at an angle to the top edges thereof. A grouting material is provided between the rabbet 32 and flange 34 while the support pieces 84 are welded together along the top edges to complete the interconnection. A number of other means for interconnecting the base slab unit 20 and the cantilever member 24 can be used. For example, a plurality of spaced bolts extending into both the rabbet 32 and flange 34 and held therein could be utilized.

Based on the foregoing description, a number of advantages of the present invention are readily discernable. A building can be formed of elements precast at one location which are then movable to a construction site where they can be erected in a relatively short time. The building elements are quickly and efficiently preformed. Additionally, interconnecting members can be precast in the building elements as well as plumbing and electrical fixtures to further lessen construction time. Different shapes of buildings can be formed by using, for example, either rectangular shaped wall tree units or trapezoidal shaped wall tree units. Furthermore, the building can be of any desired width or height so that the building elements of this invention can be used to form apartment houses, offices, industrial buildings, and parking structures. The building elements also provide a durable and long-lasting construction, as well as maximizing the sound proofing of the building.

Although the present invention has been described with reference to a particular embodiment thereof, it is readily appreciated that various modifications can be effected within the spirit and scope of this invention.

I claim:

1. A wall tree unit for use in precast building construction in conjunction with one or more base slab units and one or more wall tree units, said wall tree unit comprising:

a generally planar wall segment having a substantially uniform thickness throughout and including a first end and a second end for forming a wall portion in a building;

a first generally planar cantilever member integrally joined to said wall segment and extending at right angles from said wall segment while extending the entire lateral width of said wall segment to form a floor or roof portion of a building;

a second generally planar cantilever member integrally joined to said wall segment, said second cantilever member extending at right angles from said wall segment in a direction opposite that of said first cantilever member while extending the entire lateral width of said wall segment, said second cantilever member being substantially coaxial with said first cantilever member to form another floor or roof portion of a building;

means formed in an outer edge of each of said first and second cantilever members for matingly receiving a base slab unit;

an insert formed in a first end of said wall segment;

a hoisting eye having an opening formed inwardly of said wall segment adjacent a second, opposite end of said wall segment;

an angle brace connected to said second end of said wall segment in the hoisting eye opening and having a first arm and a second arm, said second arm having an opening; and a shaft insertable in said insert through said second arm opening for interconnecting two vertically adjacent wall trees with said insert being accessible through said hoisting eye opening.

2. A modular building construction unit in which building elements can be constructed at one location and then moved to and erected at a building site, said construction unit comprising:

a plurality of wall trees, each wall tree including a planar wall segment at least two stories high and having at least two planar cantilever members extending at right angles from each wall segment at one story spacing from each other, at least a pair of said wall trees spaced from each other with their cantilever members extending toward each other, at least two of said wall trees interconnected together along side edges of said two wall segments of said two wall trees to form horizontally adjacent wall trees, said side edges including grooves extending throughout the vertical extent of said two wall segments, each of said two horizontally adjacent wall segments having a passage extending horizontally therethrough, said passages of said two horizontally adjacent wall segments being axially aligned;

at least one base slab unit extending between and interconnecting two of said spaced cantilever members of said pair of wall tree units;

adhesive means placed in said grooves of said wall segment side edges to connect said horizontally adjacent wall trees together; and a rod inserted through each of said two wall segment passages to further connect said two horizontally adjacent wall trees together.

* * * * *